US007235504B2

(12) United States Patent
Shirasaki et al.

(10) Patent No.: US 7,235,504 B2
(45) Date of Patent: Jun. 26, 2007

(54) THREE DIMENSIONAL KNITTED FABRIC HAVING UNEVENNESS

(75) Inventors: Fumio Shirasaki, Fukui (JP); Kazunori Yamada, Fukui (JP); Yukito Kaneko, Fukui (JP)

(73) Assignee: Seiren Co., Ltd., Fukui (JP)

( * ) Notice: Subject to any disclaimer, the term of this patent is extended or adjusted under 35 U.S.C. 154(b) by 25 days.

(21) Appl. No.: 10/255,677

(22) Filed: Sep. 27, 2002

(65) Prior Publication Data

US 2003/0101776 A1 Jun. 5, 2003

(30) Foreign Application Priority Data

Sep. 28, 2001 (JP) ..... 2001-303508

(51) Int. Cl.
*D04B 21/06* (2006.01)

(52) U.S. Cl. ..... 442/314; 442/304; 442/312; 442/313; 442/318; 66/195; 66/196

(58) Field of Classification Search ..... 442/304, 442/318, 312, 313, 314; 66/196, 195
See application file for complete search history.

(56) References Cited

U.S. PATENT DOCUMENTS

| | | | | |
|---|---|---|---|---|
| 4,133,191 | A * | 1/1979 | Blore et al. | 66/197 |
| 4,601,940 | A * | 7/1986 | Fischer | 428/178 |
| 4,787,219 | A * | 11/1988 | Sato et al. | 66/190 |
| 5,501,891 | A * | 3/1996 | Saika et al. | 428/71 |
| 5,807,295 | A * | 9/1998 | Hutcheon et al. | 602/42 |
| 5,972,477 | A * | 10/1999 | Kim et al. | 428/175 |
| 6,630,414 | B1 | 10/2003 | Matsumoto | |
| 6,644,070 | B2 * | 11/2003 | Ikenaga et al. | 66/196 |
| 6,758,068 | B2 * | 7/2004 | Shirasaki et al. | 66/195 |

FOREIGN PATENT DOCUMENTS

| | | |
|---|---|---|
| JP | 56-123470 | 9/1981 |
| JP | 62-57973 | 3/1987 |
| JP | 1-40135 | 8/1989 |
| JP | 4-146246 | 5/1992 |
| JP | 4-222260 | 8/1992 |
| JP | 4-327259 | 11/1992 |
| JP | 9-137380 | 5/1997 |

(Continued)

OTHER PUBLICATIONS

Full English translation of JP 04-222260, translated by FLS, Inc.*

(Continued)

*Primary Examiner*—Andrew Piziali
(74) *Attorney, Agent, or Firm*—Finnegan, Henderson, Farabow, Garrett & Dunner, L.L.P.

(57) ABSTRACT

A three-dimensional knitted fabric having front and back ground structures and an interconnection yarn uniting the ground structures. At least one of the front and back ground structures of the three-dimensional knitted fabric has an uneven pattern with projections and depressions having a great level difference. Ground yarns of the at least one ground structure are traversed by a predetermined traverse width so that the projections each have a curved shape having a distinct curvature in section, and cast off at predetermined intervals so that the depressions each have an opening.

5 Claims, 15 Drawing Sheets

FOREIGN PATENT DOCUMENTS

| | | |
|---|---|---|
| JP | 10-33456 | 2/1998 |
| JP | 2000-265345 | 9/2000 |
| JP | 2001-011757 | 1/2001 |
| JP | 2001-089959 | 4/2001 |
| JP | 3482489 | 10/2003 |

OTHER PUBLICATIONS

"Warp Knitting," by Nippon Mayer Ltd. (Oct. 1, 1982) Contents V. VI, VIII, pp. 77 and 158.

* cited by examiner

FIG. 2A THREE-STITCH TRAVERSE
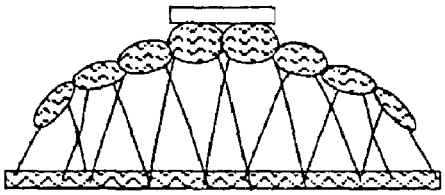
FIG. 2B SIX-STITCH TRAVERSE
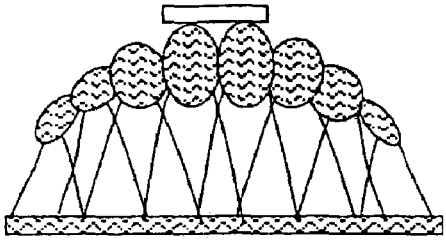
FIG. 2C EIGHT-STITCH TRAVERSE
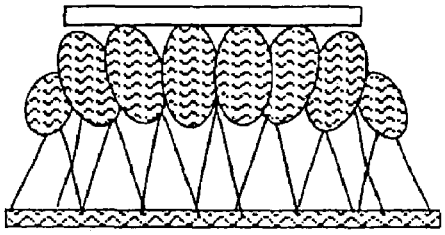
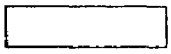
··· CONTACT AREAS

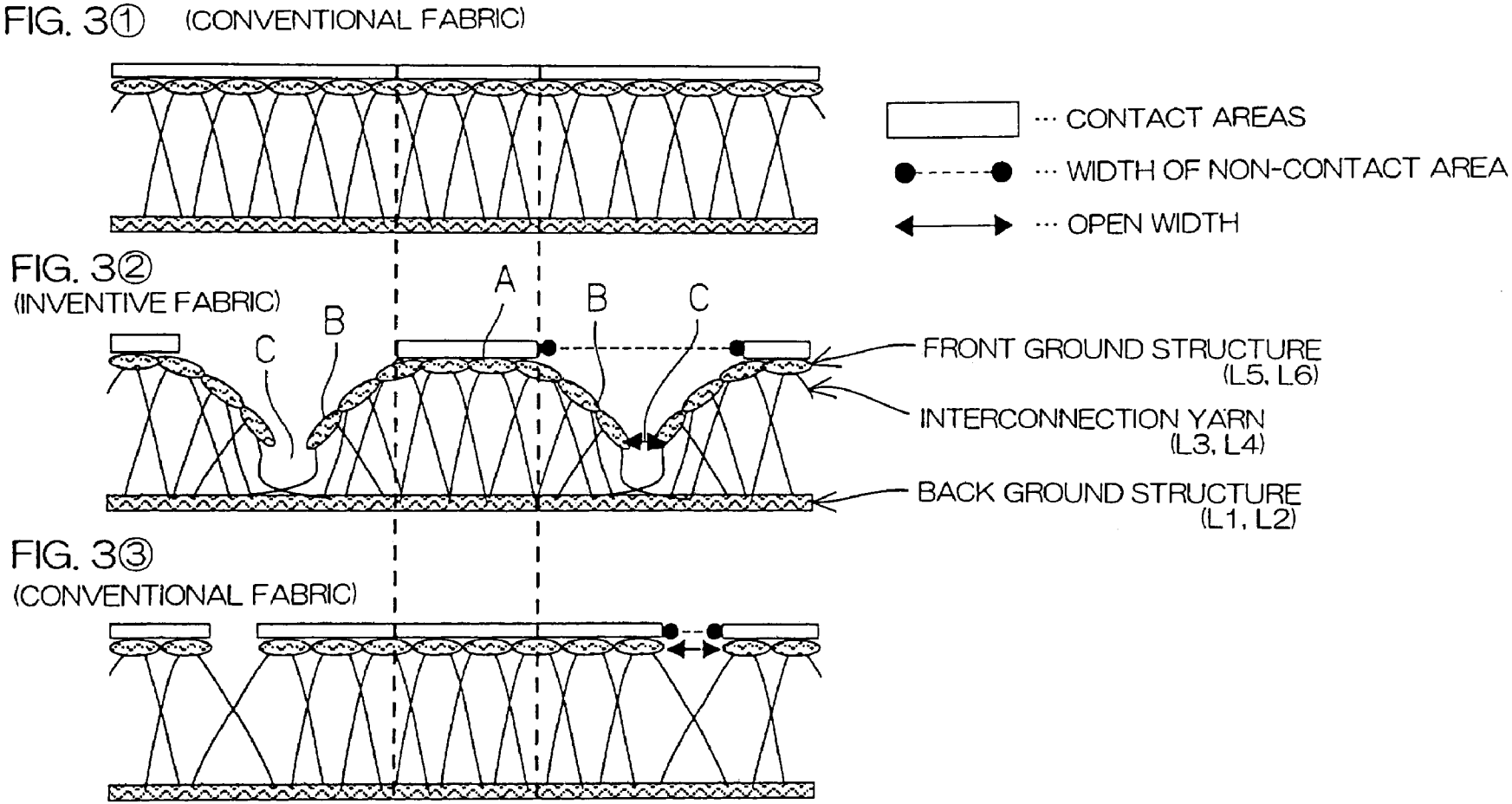
FIG. 3① (CONVENTIONAL FABRIC)
FIG. 3② (INVENTIVE FABRIC)
FIG. 3③ (CONVENTIONAL FABRIC)

FIG. 8
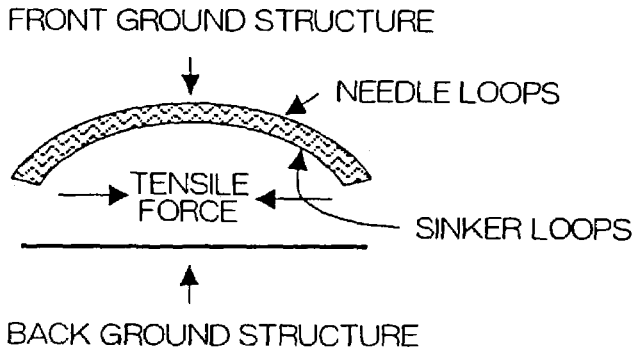
FIG. 9① (CONVENTIONAL FABRIC)
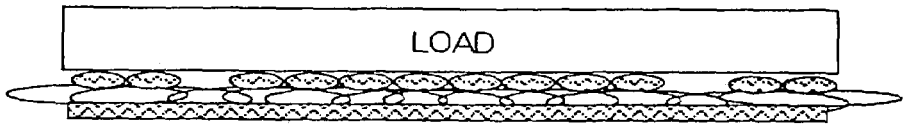
FIG. 9② (INVENTIVE FABRIC)
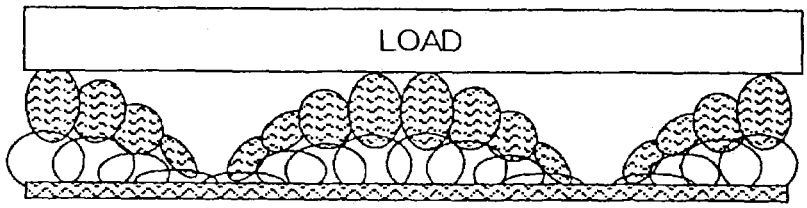
FIG. 10
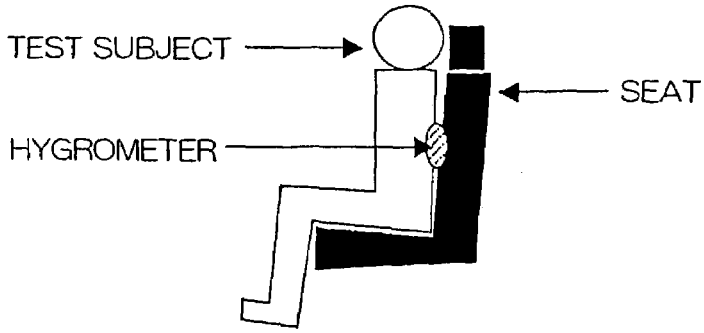

THREE DIMENSIONAL KNITTED FABRIC HAVING UNEVENNESS

BACKGROUND OF THE INVENTION

1. Field of the Invention

The present invention relates to a three-dimensional knitted fabric having unevenness and, more specifically, to a three-dimensional uneven knitted fabric which is free from stickiness and uncomfortableness which may otherwise occur due to sweat.

2. Description of Related Art

Three-dimensional knitted fabrics comprising front and back ground structures and an interconnection yarn uniting the front and back structures are used in various fields because of their excellent repulsive, cushioning and air permeability.

In the field of garments, the three-dimensional knitted fabrics are used for ordinary garments, sportswear and innerwear. In the field of upholstery materials, the three-dimensional knitted fabrics are widely used as cushioning materials for automobile seats, chairs and beds. By providing an uneven pattern on a surface of such a three-dimensional knitted fabric, the total area of surface portions of the fabric to be brought into contact with human body is reduced, thereby improving the air permeability and texture of the fabric.

Several methods are proposed for providing an uneven pattern on a surface of a woven or knitted fabric. For example, Japanese Examined Patent Publication (KOKOKU) No. 1-40135 (1989) proposes that a ribbed stripe pattern is formed on a woven or knitted fabric by applying high-pressure liquid streams onto the fabric.

Japanese Unexamined Patent Publication (KOKAI) No. 4-146246 (1992) proposes that a pattern is formed on a knitted fabric by heat-pressing the knitted fabric by means of a calender roll.

Further, a method for forming a three-dimensional pattern on a fabric produced with the use of a heat-shrinkable yarn through heat-treatment is proposed (Japanese Unexamined Patent Publications (KOKAI) No. 4-222260 (1992) and No. 4-327259 (1992)).

However, the ribbed pattern formation method employing the high pressure liquid streams is disadvantageous with difficulty in sustaining the ribbed pattern for a long period of time. The method employing the heat press is disadvantageous in that the resulting fabric is poor in texture with its stitches collapsed and with its surface hardened. The method employing the heat-shrinkable yarn is disadvantageous in that the resulting fabric is less uneven with a smaller level difference.

There are known methods for forming an uneven pattern in a knitted structure without any of the aforesaid post treatments. For example, Japanese Unexamined Patent Publication (KOKAI) No. 9-137380 (1997) discloses a method for forming an uneven structure by mesh stitches, broad stitches and tuck stitches. Further, in Japanese Unexamined Patent Publication (KOKAI) No. 2001-11757, the inventors of the present invention disclose a method for forming an uneven pattern on a fabric by knitting two types of yarns having different finenesses while adjusting a traverse width.

These methods indeed provide the uneven pattern on the fabric. However, the uneven pattern is not satisfactory with a smaller level difference and with a greater total area of projections to be brought into contact with human body. Particularly where such a fabric is employed for an automobile seat, stickiness and sweatiness cannot satisfactorily be eliminated which may occur, for example, when a person sits on the seat for a long period of time in summer.

SUMMARY OF THE INVENTION

The inventors of the present invention found that a three-dimensional knitted fabric excellent in air permeability and cushioning properties for use as an upholstery material can be provided by employing a specific ground structure knitting method and a ground knitted structure in combination to solve the aforesaid drawbacks, thereby attaining the present invention. It is therefore an object of the present invention to provide a three-dimensional uneven knitted fabric of a comfortable structure which has a light weight, a higher compression elasticity, a higher air permeability and a soft texture with a greater volume of voids for use as a material for an automobile seat, a chair, a bed and the like and is free from steaminess and sweatiness.

To achieve the aforesaid object, the present invention provides a three-dimensional knitted fabric comprising front and back ground structures and an interconnection yarn uniting the front and back ground structures, at least one of the front and back ground structures having an uneven pattern with projections and depressions having a great level difference, wherein ground yarns of the at least one ground structure are traversed by a predetermined traverse width so that the projections each have a curved shape having a distinct curvature in section, and cast off at predetermined intervals so that the depressions each have an opening.

Since the at least one of the front and back ground structures of the three-dimensional knitted fabric according to the present invention has the aforesaid construction, the at least one ground structure has the uneven pattern having a great level difference. The projections each have a curved shape having a distinct curvature in section, and the depressions each have an opening to form a mesh structure. Thus, the projections in closed portions of the ground structure each have a round cross section, so that the total area of surface portions of the fabric to be brought into contact with a foreign object is reduced for significant improvement of the air permeability of the fabric. Since the total area of the surface portions of the fabric to be brought into contact with human body is reduced, the fabric provides a comfortable texture, and is free from stickiness which may otherwise occur due to sweat. Particularly where the fabric is applied to an automobile seat, the fabric is free from uncomfortableness. Since the projections in the curved closed portions of the ground structure each have an increased volume, the three-dimensional knitted fabric has excellent cushioning and compression resistant properties.

The traverse width of the ground yarns of the at least one of the front and back ground structures is preferably 3 to 7 stitches to provide the effect of the present invention.

In the inventive three-dimensional uneven knitted fabric, the ground yarns preferably each have a fineness of 150 to 550 decitex to provide the effect of the present invention.

In the inventive three-dimensional uneven knitted fabric, the ground yarns are preferably polyester yarns to provide the effect of the present invention.

Particularly, the inventive three-dimensional uneven knitted fabric is preferably applied to an automobile seat.

The foregoing and other objects, features and effects of the present invention will become more apparent from the following description of the preferred embodiments with reference to the attached drawings.

BRIEF DESCRIPTION OF THE DRAWINGS

FIGS. 2A, 2B and 2C are sectional views each illustrating an inventive three-dimensional knitted fabric;

FIGS. 3①, 3② and 3③ are schematic diagrams for comparison between the present invention and the prior art;

FIG. 8 is a schematic diagram for explaining a bulged portion of the ground structure;

FIGS. 9① and 9② are diagrams illustrating three-dimensional knitted fabrics deformed under application of a load;

FIG. 10 is a schematic diagram for explaining the measurement of sweatiness;

DESCRIPTION OF THE PREFERRED EMBODIMENTS

Figure 1:
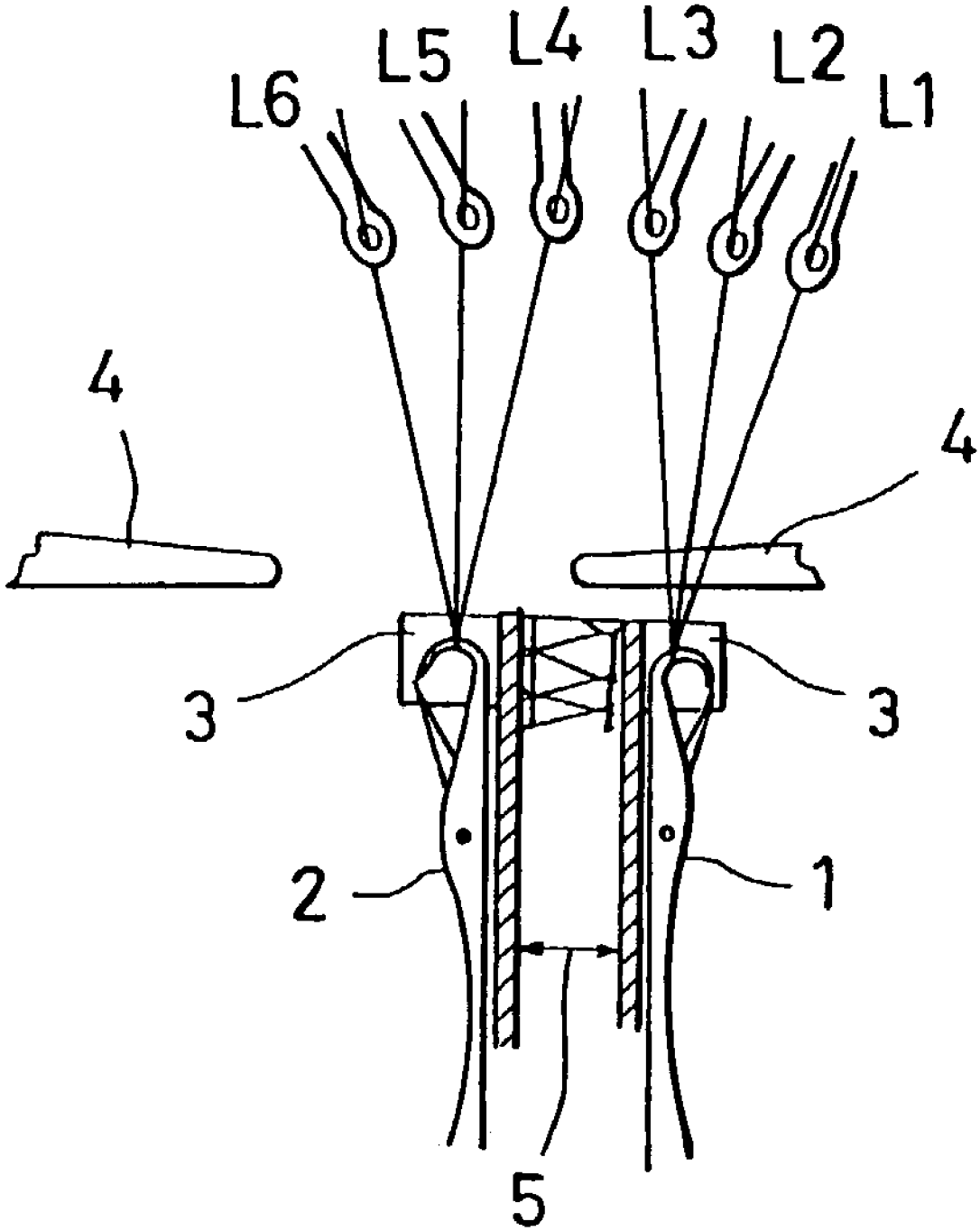
FIG. 1 is a schematic diagram illustrating major knitting members of a double Raschel machine.

A three-dimensional uneven knitted fabric according to the present invention can be knitted, for example, by means of a double Raschel warp knitting machine having six guide bars as shown in FIG. 1. Yarns respectively passing through guide bars L1 and L2 are knitted into one of ground structures (front or back structure), and yarns respectively passing through guide bars L5 and L6 are knitted into the other of the ground structures (back or front ground structure). The front and back ground structures are united into the three-dimensional knitted fabric by yarns respectively passing through guide bars L3 and L4. The yarns passing through the guide bars L5, L6 (or L1, L2) are knitted while being traversed by a predetermined traverse width and cast off at predetermined intervals, whereby a mesh pattern having openings is formed on the resulting ground structure. Thus, at least one of the front and back ground structures has an uneven pattern with projections and depressions having a great level difference. The projections each have a curved shape having a distinct curvature in section. In FIG. 1, there are also shown needle bars (needles) 1 and 2 on front and back needle bases, trick plates 3 on the front and back needle bases and stitch combs 4 on the front and back sides. A reference numeral 5 indicates a base distance.

Materials for the front and back ground structures and the interconnection yarns are not particularly limited, but may properly be selected depending on the application of the fabric. Where the fabric is employed as an upholstery material, polyester yarns are preferred in terms of wear resistance.

A three-dimensional knitted fabric typified by a double Raschel fabric comprises front and back ground structures and an interconnection yarn uniting the front and back ground structures with voids therein and, hence, is intrinsically excellent in air permeability. Where the uneven pattern with the projections and the depressions having a great level difference is additionally provided on at least one of the surfaces of the fabric, the surface is less liable to be brought into intimate contact with human body. Thus, the air permeability is further improved, and the sweatiness and the stickiness are more effectively eliminated.

The uneven pattern may be provided on either of the front and back ground structures, but it is essential to provide the uneven pattern on at least a surface of the fabric to be brought into contact with human body. Where the fabric is applied to an automobile seat, a chair or a bed, the fabric should have the uneven pattern on the surface thereof to be brought into contact with human body.

Figure 7:
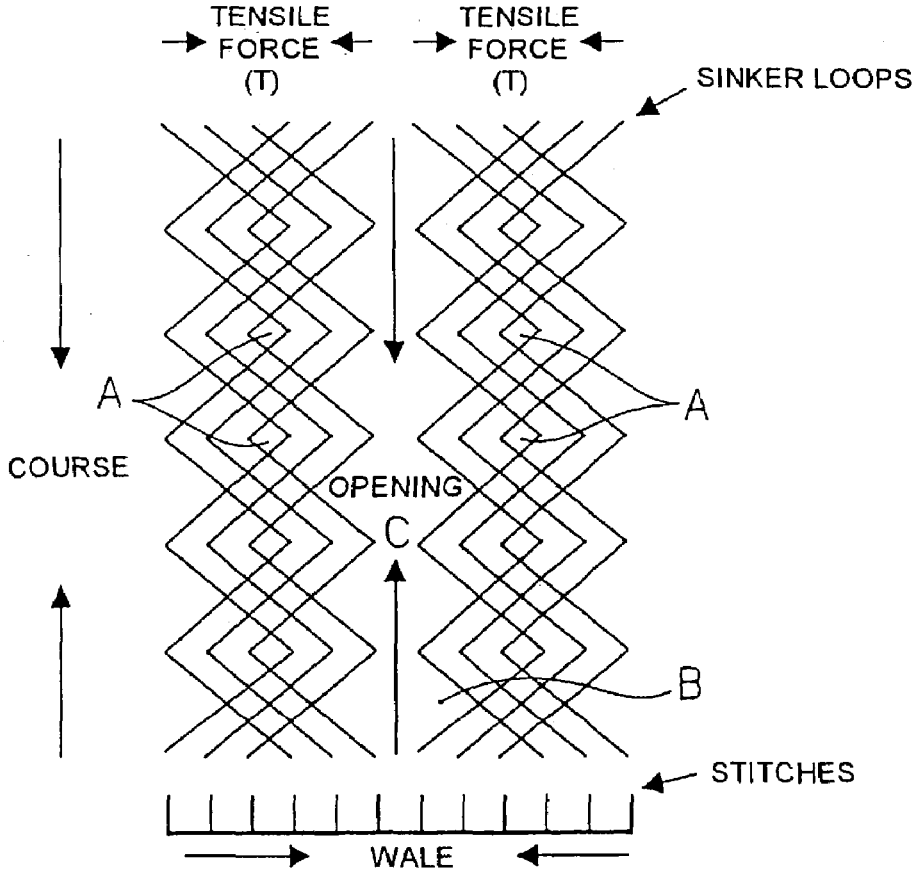
FIG. 7 is a schematic diagram illustrating an exemplary knitting pattern according to the present invention.

In the present invention, the traverse width of the ground yarns of the ground structure is preferably set in a predetermined range. In addition, the ground yarns are cast off at predetermined intervals for formation of various uneven patterns. Where the ground yarns are traversed by a great traverse width, a plurality of ground yarns overlap with each other in the traversed portion. The number of the overlapping ground yarns increases, as the traverse width increases. As shown in FIG. 7, tensile forces (T) toward the centers of the projections A are generated in portions of the ground structure where the plurality of ground yarns overlap with each other. Since the ground yarns are cast off at the predetermined intervals, counter forces (not shown) cancelling the tensile forces (T) do not occur. Therefore, the projections A are formed. The depressions B are formed between the projections A.

FIGS. 2A, 2B and 2C are diagrams for explaining the traverse width and the formation of the projections in greater detail. FIG. 2A illustrates a three-dimensional knitted fabric formed by traversing ground yarns of sinker loops by a traverse width of three stitches. FIG. 2B illustrates a three-dimensional knitted fabric formed by traversing ground yarns by six stitches. By increasing the traverse width, the number of overlapping sinker loops is increased, so that the thickness of the ground structure is increased as shown in FIGS. 2A and 2B. Therefore, the resulting three-dimensional knitted fabric has more bulged projections with a greater curvature. FIG. 2C illustrates a three-dimensional knitted fabric formed by traversing ground yarns by eight stitches. With a greater traverse width, the ground structure has a greater thickness. However, too many sinker loops overlap with each other, so that the movement of the sinker loops is restricted. This makes it difficult for the projection to totally have a round curvature, but only portions of the projection where a smaller number of sinker loops overlap are curved. Accordingly, the ground structure of the three-dimensional knitted fabric is liable to have a greater thickness and a smaller curvature as shown in FIG. 2C. Therefore, the ground yarns are knitted while being traversed by a traverse width within a predetermined range and cast off at predetermined intervals, whereby the uneven pattern can be formed on the three-dimensional knitted fabric.

The number of stitches (traverse width) by which the ground yarns are traversed to provide an uneven pattern having a great level difference with projections having a curved shape having a distinct curvature in section should properly be selected depending on the characteristics of the ground yarns. In general, the traverse width is preferably 3 to 7 stitches, more preferably 3 to 6 stitches, to provide a three-dimensional uneven knitted fabric which ensures comfortable use. If the traverse width is not greater than 2 stitches, the resulting ground structure has an insufficient thickness, failing to have the projections A. If the traverse width is not smaller than 8 stitches, the projections fail to have a desired curvature for the aforesaid reason, making it difficult to provide a comfortable three-dimensional knitted fabric. By thus setting the traverse width of the ground yarns in the predetermined range, the uneven pattern can stably be formed on the three-dimensional knitted fabric.

In the present invention, the ground yarns are knitted while being traversed by a traverse width within the predetermined range and cast off at the predetermined intervals to provide a mesh pattern having openings, whereby the three-dimensional fabric is provided which has the projections A each having a great curvature in section.

FIG. 3① is a sectional view illustrating a three-dimensional knitted fabric including a ground structure knitted by traversing ground yarns by a predetermined traverse width but not casting off the ground yarns at predetermined intervals. FIG. 3② is a sectional view illustrating a three-dimensional knitted fabric according to the present invention. As can be understood from a comparison between these figures, the three-dimensional knitted fabric of FIG. 3① in which the ground yarns are not cast off at the predetermined intervals has no level difference, because the tensile forces (T) serving for the formation of the curved projections are offset by the counter forces so that the level difference is absorbed by the ground structure.

FIG. 3③ is a sectional view illustrating a conventional three-dimensional knitted fabric of a mesh structure having pseudo-unevenness. In comparison with the sectional view of the inventive fabric, the conventional three-dimensional knitted fabric has substantially the same open width, but has a much greater contact area. More specifically, the inventive three-dimensional knitted fabric includes curved projections A each having a greater curvature in section and, hence, has a smaller contact surface area to be brought into contact with a foreign object (e.g., human body). Since the ground yarns are cast off to form a mesh pattern having openings C in the depressions B having a greater level difference with respect to the projections A, the air permeability of the fabric is improved. Further, the compression resistance of the fabric is improved by increasing the number of interconnection yarns incorporated in unit area.

Figure 4:
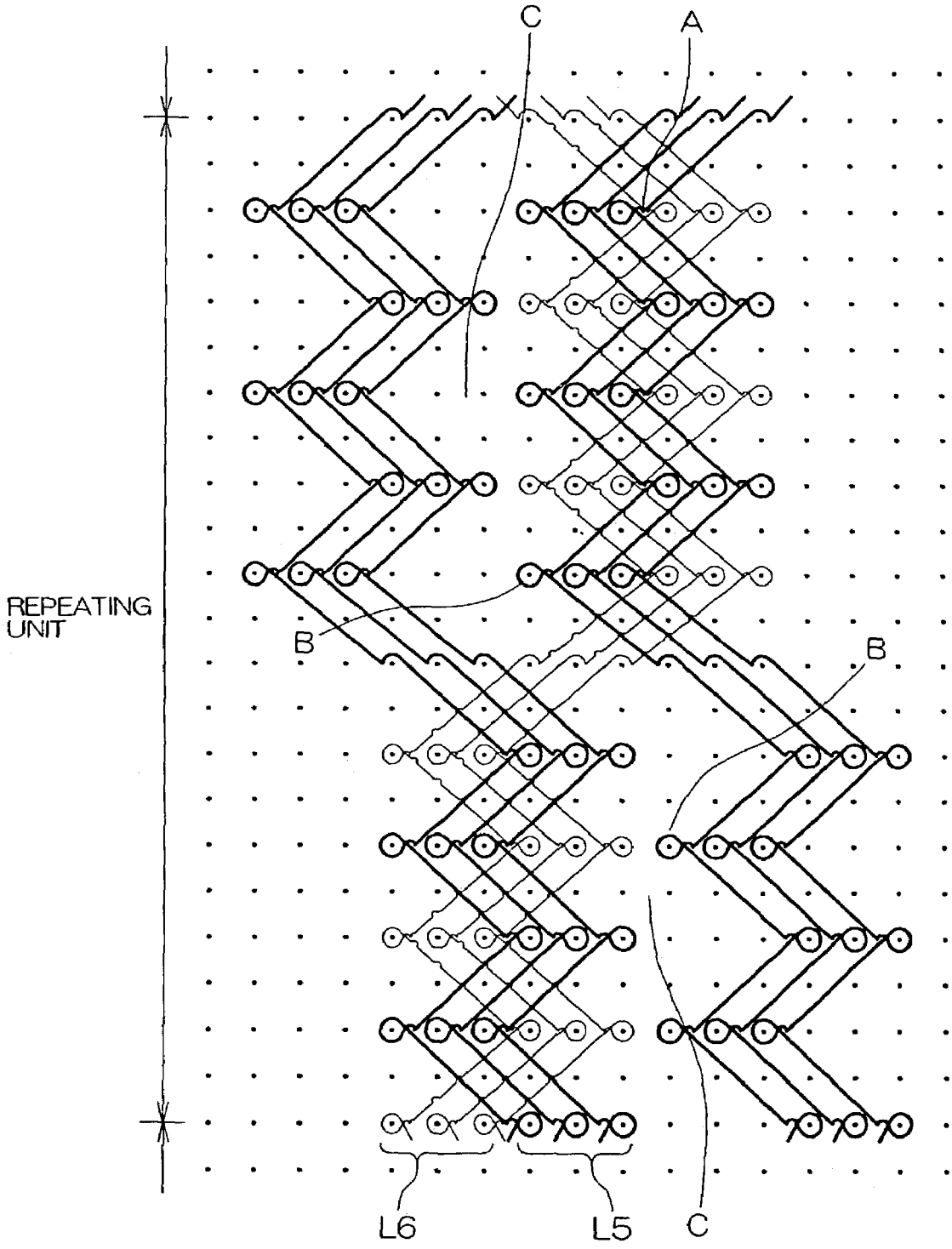
FIG. 4 is a diagram illustrating a ground yarn stitch pattern of one of front and back ground structures according to the present invention.
Figure 5:
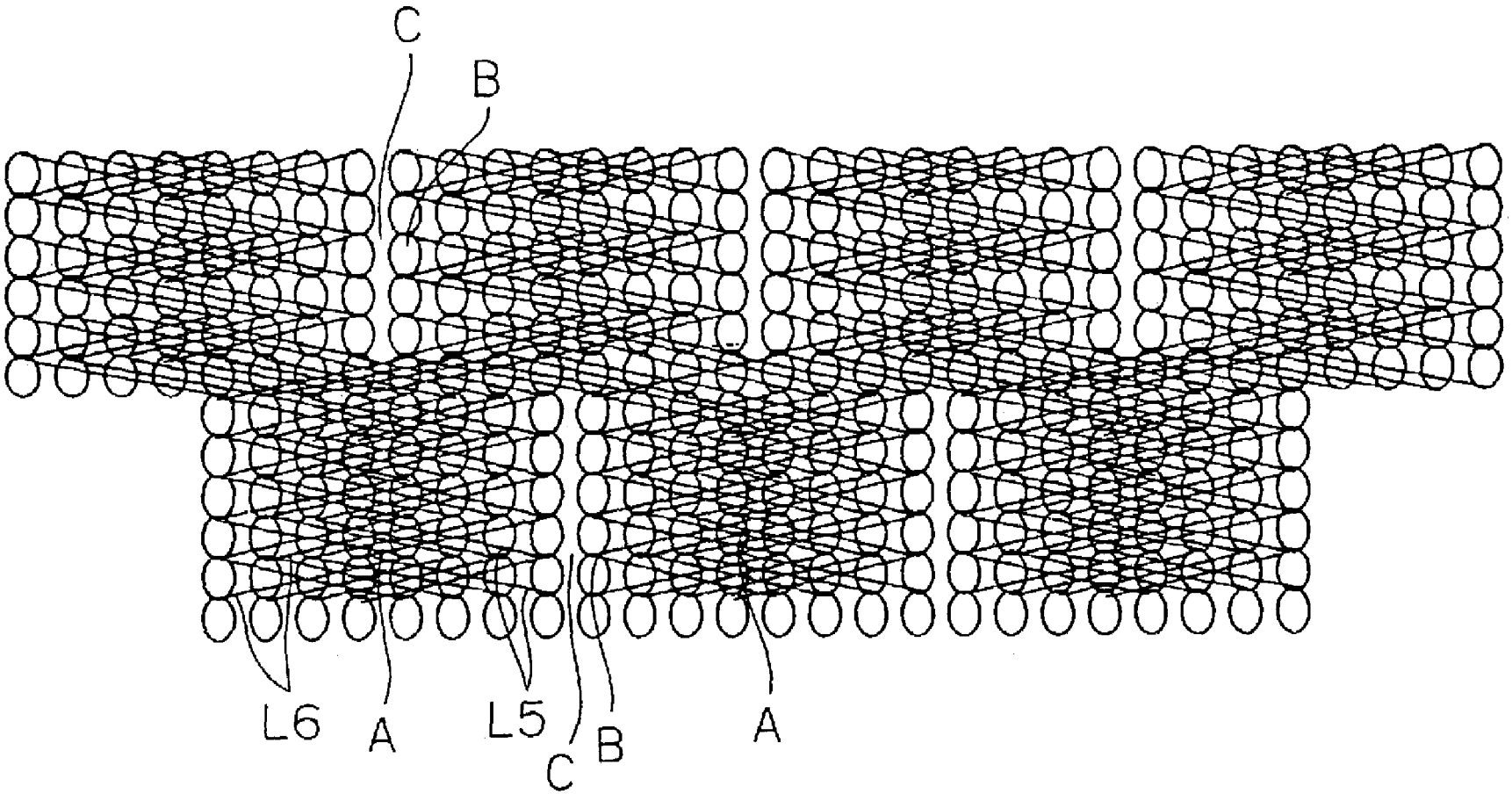
FIG. 5 is a three-dimensional ground yarn stitch pattern of the one of the front and back ground structures according to the present invention.

In FIGS. 4 and 5, the ground yarns guided by the guide bars L5 and L6 are illustrated as L5 and L6, respectively, which are knitted while being traversed by the predetermined traverse width and cast off as described above for the formation of the depressions B and the projections A shown in FIG. 3②. Further, the openings in the mesh pattern formed by overlapping and casting off the ground yarns are denoted by a reference character C.

A method for knitting the three-dimensional knitted fabric according to the present invention will be described in detail.

Figure 6:
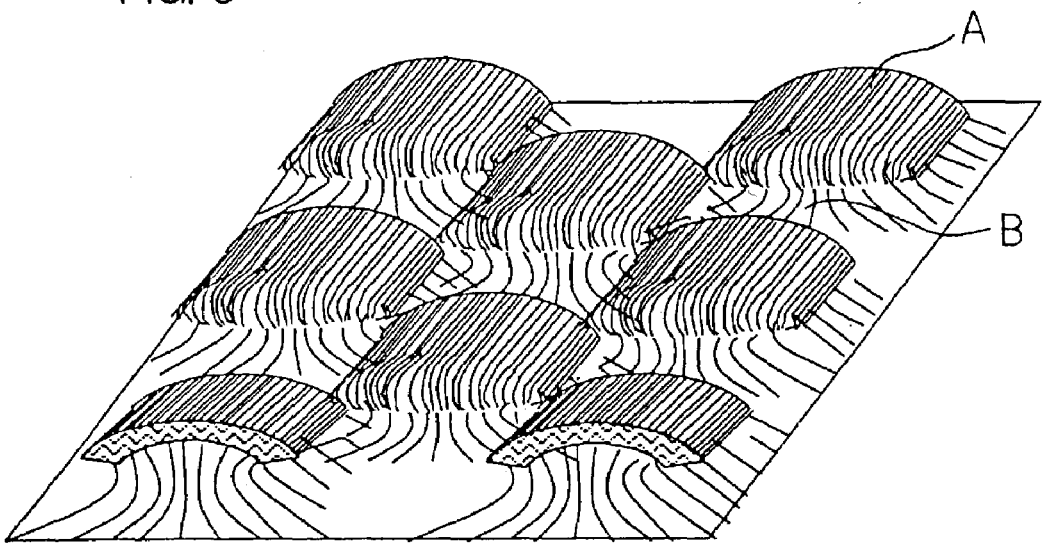
FIG. 6 is a perspective view of the three-dimensional knitted fabric according to the present invention.

FIG. 6 is a perspective view illustrating the inventive three-dimensional knitted fabric.

FIG. 8 schematically illustrates how to knit a three-dimensional structure having a level difference with bulged needle loops. In FIG. 8, the movement of sinker loops and needle loops and the tensile forces are shown.

The bulge of the needle loops (the height of the projections) heavily depends on distances between the sinker loops of the knitted yarns and the fineness of the knitted yarns.

More specifically, as the distances between the sinker loops are increased, the tensile forces are increased thereby to more strongly pull the needle loops toward the centers of the projections of the ground structure. Thus, the projections of the ground structure are more bulged.

The sinker loops extend downward from the needle loops. Where the sinker loops are traversed across three or more stitches, three, four or more yarns overlap with each other, so that the needle loops significantly project. As a result, the projections totally have an increased level difference.

By thus setting the traverse width of the ground yarns of the ground structure in the predetermined range and knitting the ground structure into the mesh pattern, the three-dimensional knitted fabric having the uneven pattern with a greater level difference can be provided.

The inventive three-dimensional uneven knitted fabric is characterized in that the projections thereof each have an arcuately curved cross section. FIGS. 9① and 9② are diagrams illustrating the shapes of three-dimensional knitted fabrics under application of a load. A conventional three-dimensional knitted fabric is collapsed with virtually no void therein as shown in FIG. 9① when a load unsupportable by interconnection yarns is applied to the fabric. On the other hand, the inventive three-dimensional knitted fabric of FIG. 9② whose projections each have a sufficient curvature and thickness can sustain the voids even if the interconnection yarns are collapsed. Therefore, the inventive three-dimensional knitted fabric is comfortable and virtually free from sweatiness with air flow paths therein.

The ground yarns preferably each have a fineness of 150 to 550 decitex from the viewpoint of the thickness, air permeability and rigidity of the knitted fabric. If the fineness of the ground yarns is smaller than 150 decitex, it is difficult to provide the uneven pattern with a sufficient level difference. If the fineness of the ground yarns is greater than 550 decitex, the texture of the knitted fabric is unsatisfactory.

The gauge of the knitting machine is preferably 16 to 30 gauges/inch from the viewpoint of the thickness, air permeability and rigidity of the knitted fabric.

Since the knitted fabric has the uneven pattern on its surface, the area of surface portions to be brought into intimate contact with human body is reduced, thereby suppressing the stickiness. Further, gaps are formed between the body and the fabric, thereby effectively improving the air permeability.

For improvement of the texture of the fabric, the front ground structure of the fabric may be subjected to a raising process or a buffing process to provide a suede-like knitted fabric having a three-dimensional pattern with fuzzy projections.

The inventive three-dimensional uneven knitted fabric which is excellent in air permeability, texture and cushioning property may be employed as materials for bedding such as a bed sheet and a bed mattress and upholstery materials for an automobile seat and a chair. Besides, the inventive fabric is applicable to a wide variety of applications.

The present invention will hereinafter be described by way of examples thereof. It should be understood that the invention is not limited to these examples, but may be embodied in any other ways.

EXAMPLES

In the following examples and comparative examples, a double Raschel machine RD6DPLM-22G available from Kurl Mayer was employed as a warp knitting machine. In FIGS. 11 to 18, yarns denoted by L-1 to L-6 indicate yarns guided by the guide bars L1 to L6, respectively.

Evaluation

Air Permeability

A fabric was tested in conformity with a air permeability test method specified in JIS L1018. The evaluation is based on the following criteria (unit: cc/sec/cm$^2$).

x: −200

Δ: 200–220

○: 220 -

Contact Area Ratio

A fabric to be tested was cut into a 7 cm×7 cm piece. After a stamp ink (Shachihata's ink pad) was uniformly applied on a surface (surface having openings) of the test fabric piece, the test fabric piece was placed on a white paper sheet. Then, a 5 kg cylindrical weight having a diameter of 7 cm was placed on the test fabric piece and allowed to stand for 10 seconds. After the white paper sheet was separated from the test fabric piece and trimmed into a size of 5 cm×5 cm, the total area of inked portions of the white paper sheet (contact area) was measured. For the measurement of the area, an image of the 5 cm×5 cm white paper sheet was read into a personal computer by a scanner. Then, the image was binarized on the basis of the colors of the ink and the white paper sheet, and the total area of ink color dots was determined by integration. The contact area ratio was determined from the following expression:

$$\text{Contact area ratio (\%)} = \frac{\text{Total area of inked portions}}{\text{Area of white paper sheet}} \times 100$$

The evaluation is based on the following criteria.

x: 30% -

Δ: 20% –30%

○: −20%

Thickness Retention Ratio

A fabric to be tested was cut into 7 cm×7 cm pieces, and four such fabric pieces were stacked for easy observation of a change in the thickness thereof. A 5 kg cylindrical weight having a diameter of 7 cm was placed on the stacked fabric pieces and allowed to stand at 100° C. for two hours. The Thickness T1 of the stacked fabric pieces before the weight was placed and the thickness T2 of the stacked fabric pieces immediately after the weight was removed two hours later were measured, and the thickness retention ratio was determined from the following expression:

$$\text{Thickness retention ratio (\%)} = T2/T1 \times 100$$

The evaluation is based on the following criteria.

x: −70%

Δ: 70% –90%

○: 90% -

Sweatiness

A seat cover was produced from a fabric to be tested, and a car seat was covered with the seat cover. Five persons (test subjects) were each allowed to sit on the seat at a room temperature of 25° C. at a relative humidity of 60% for one hour with a hygrometer held between the seat and a garment of the person, and the humidity was measured by the hygrometer. Humidity levels on the five test subjects were averaged. The hygrometer was located at a position as shown in FIG. 10.

The evaluation is based on the following criteria.

x: 70% -

Δ: 50% –70%

○: −50%

Example 1

Figure 11:
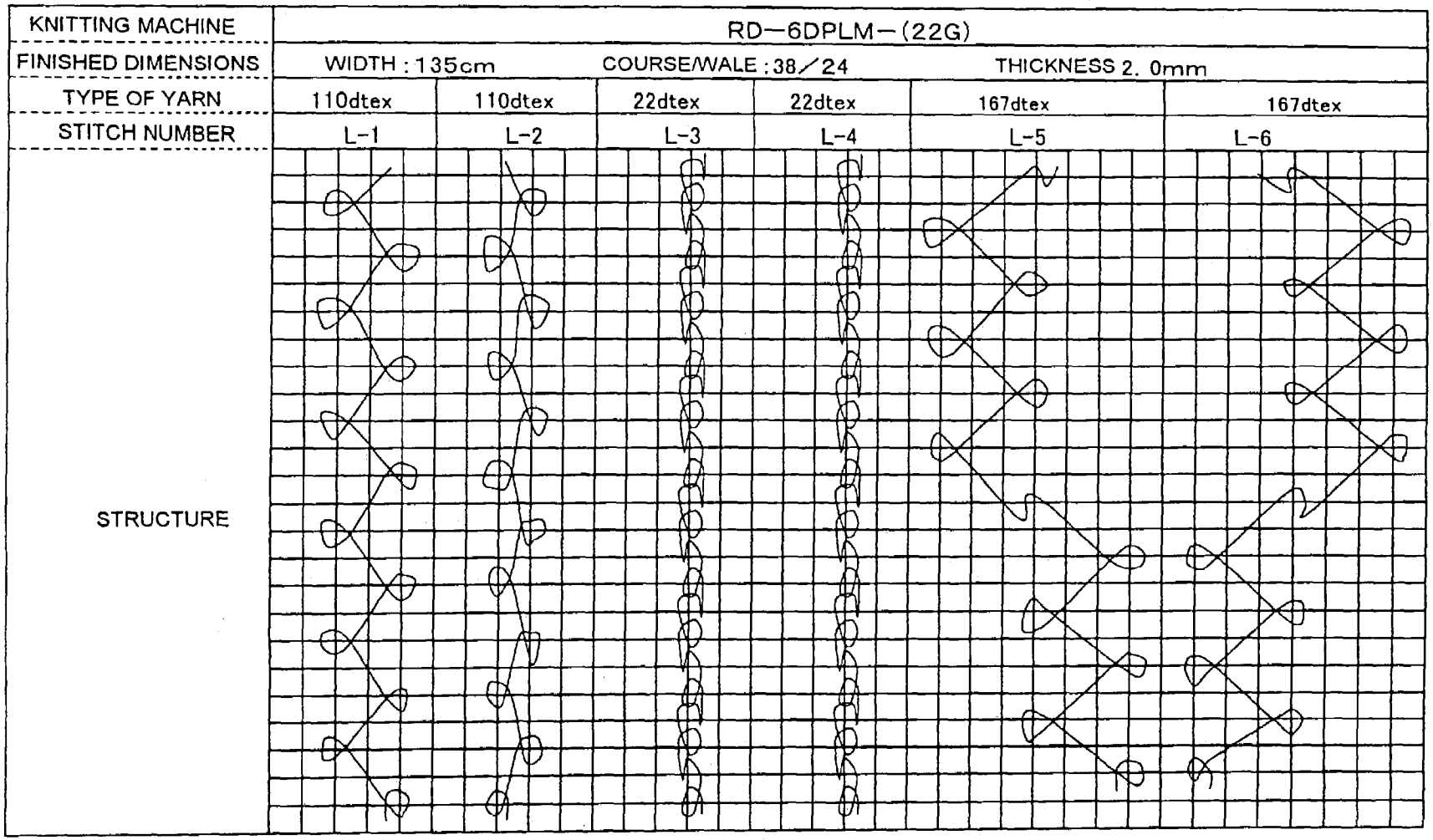
FIG. 11 is a diagram illustrating a structure according to Example 1.

A three-dimensional knitted fabric was produced on the basis of a design as shown in FIG. 11 by employing 100% polyester yarns as ground yarns and interconnection yarns. The fineness of ground yarns of an uneven ground structure of the fabric was 167 decitex.

The uneven ground structure was knitted by guiding the ground yarns through the guide bars L5 and L6 by a traverse width of three stitches. The resulting three-dimensional fabric structure was preset at 190° C. for one minute, dyed at 130° C., dried, and finally set at 150° C. for one minute. Thus, a three-dimensional knitted fabric was obtained which had a thickness of 1.8 mm and a knitting density of 38 courses/inch and 24 wales/inch and included projections each having a curved shape having a distinct curvature in section.

The three-dimensional knitted fabric thus obtained was evaluated by the aforesaid evaluation method. The results are shown in Table 1.

Example 2

Figure 12:
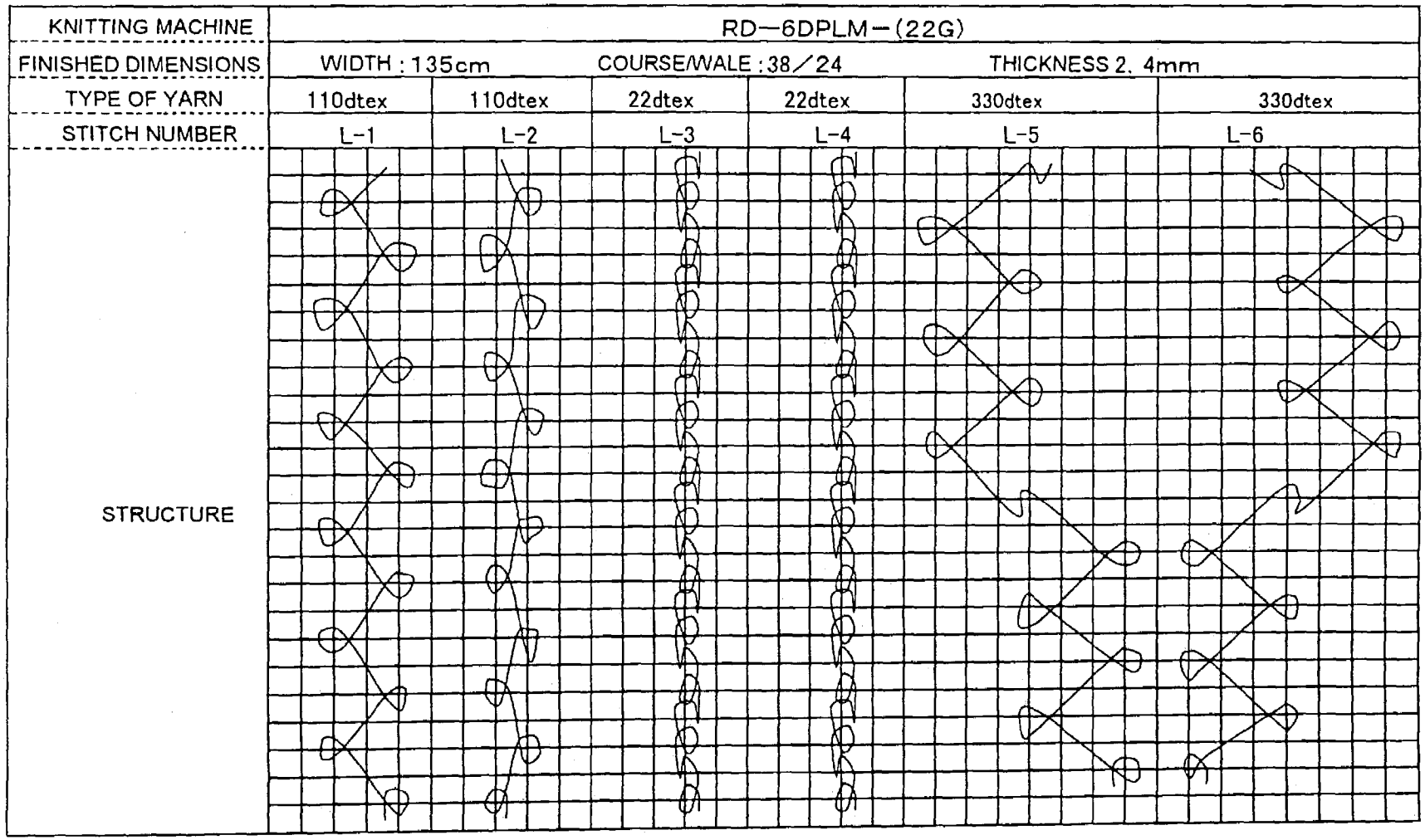
FIG. 12 is a diagram illustrating a structure according to Example 2.

A three-dimensional knitted fabric was produced on the basis of a design as shown in FIG. 12 by employing 100% polyester yarns as ground yarns and interconnection yarns. The fineness of ground yarns of an uneven ground structure of the fabric was 330 decitex.

The uneven ground structure was knitted by guiding the ground yarns through the guide bars L5 and L6 by a traverse width of three stitches. The resulting three-dimensional fabric structure was preset at 190° C. for one minute, dyed at 130° C., dried, and finally set at 150° C. for one minute. Thus, a three-dimensional knitted fabric was obtained which had a thickness of 2.2 mm and a knitting density of 38 courses/inch and 24 wales/inch and included projections each having a curved shape having a distinct curvature in section.

The three-dimensional knitted fabric thus obtained was evaluated by the aforesaid evaluation method. The results are shown in Table 1.

Example 3

Figure 13:
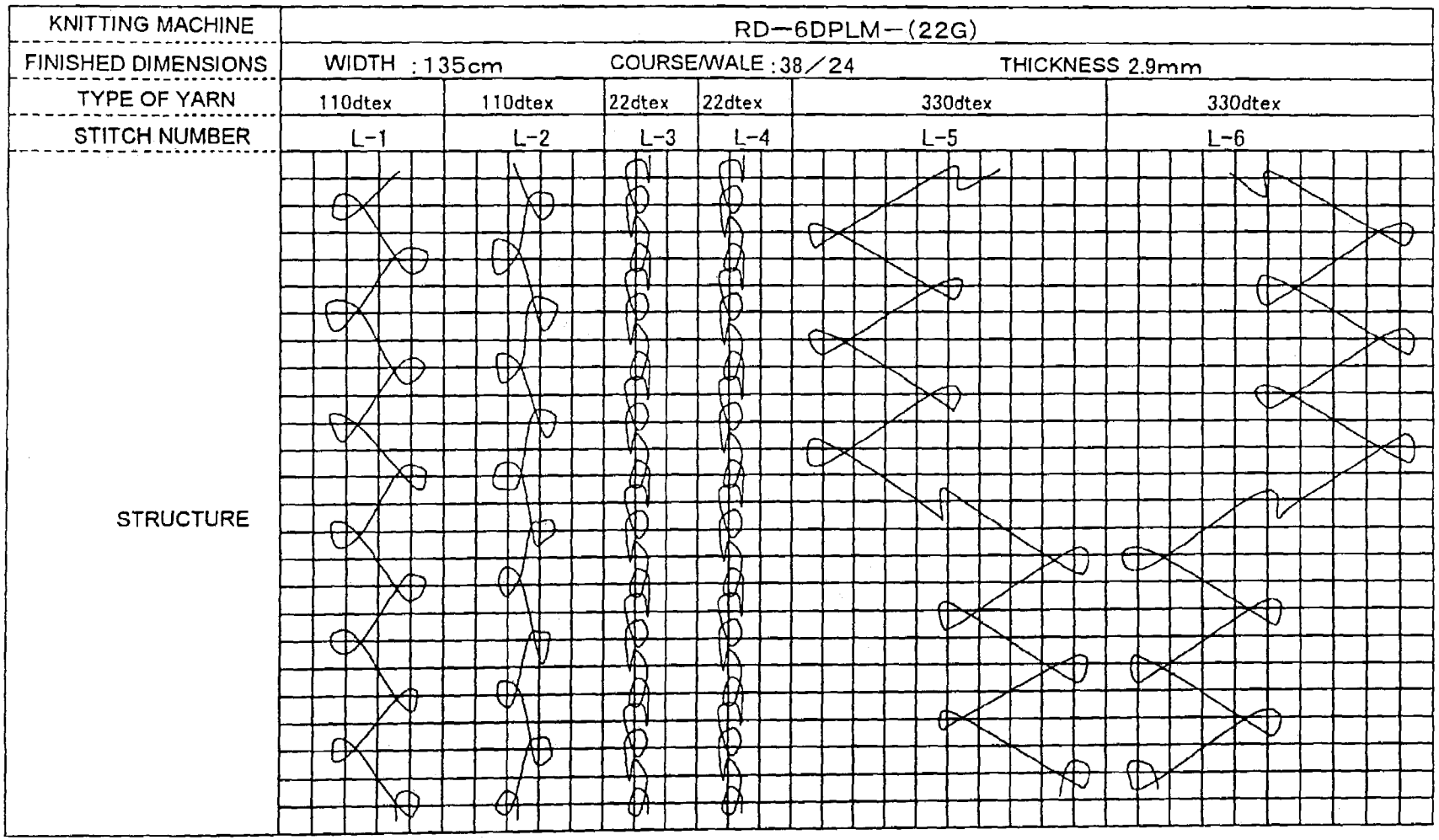
FIG. 13 is a diagram illustrating a structure according to Example 3.

A three-dimensional knitted fabric was produced on the basis of a design as shown in FIG. 13 by employing 100% polyester yarns as ground yarns and interconnection yarns. The fineness of ground yarns of an uneven ground structure of the fabric was 330 decitex.

The uneven ground structure was knitted by guiding the ground yarns through the guide bars L5 and L6 by a traverse width of four stitches. The resulting three-dimensional fabric structure was preset at 190° C. for one minute, dyed at 130° C., dried, and finally set at 150° C. for one minute. Thus, a three-dimensional knitted fabric was obtained which had a thickness of 2.7 mm and a knitting density of 38 courses/inch and 24 wales/inch and included projections each having a curved shape having a distinct curvature in section.

The three-dimensional knitted fabric thus obtained was evaluated by the aforesaid evaluation method. The results are shown in Table 1.

Example 4

Figure 14:
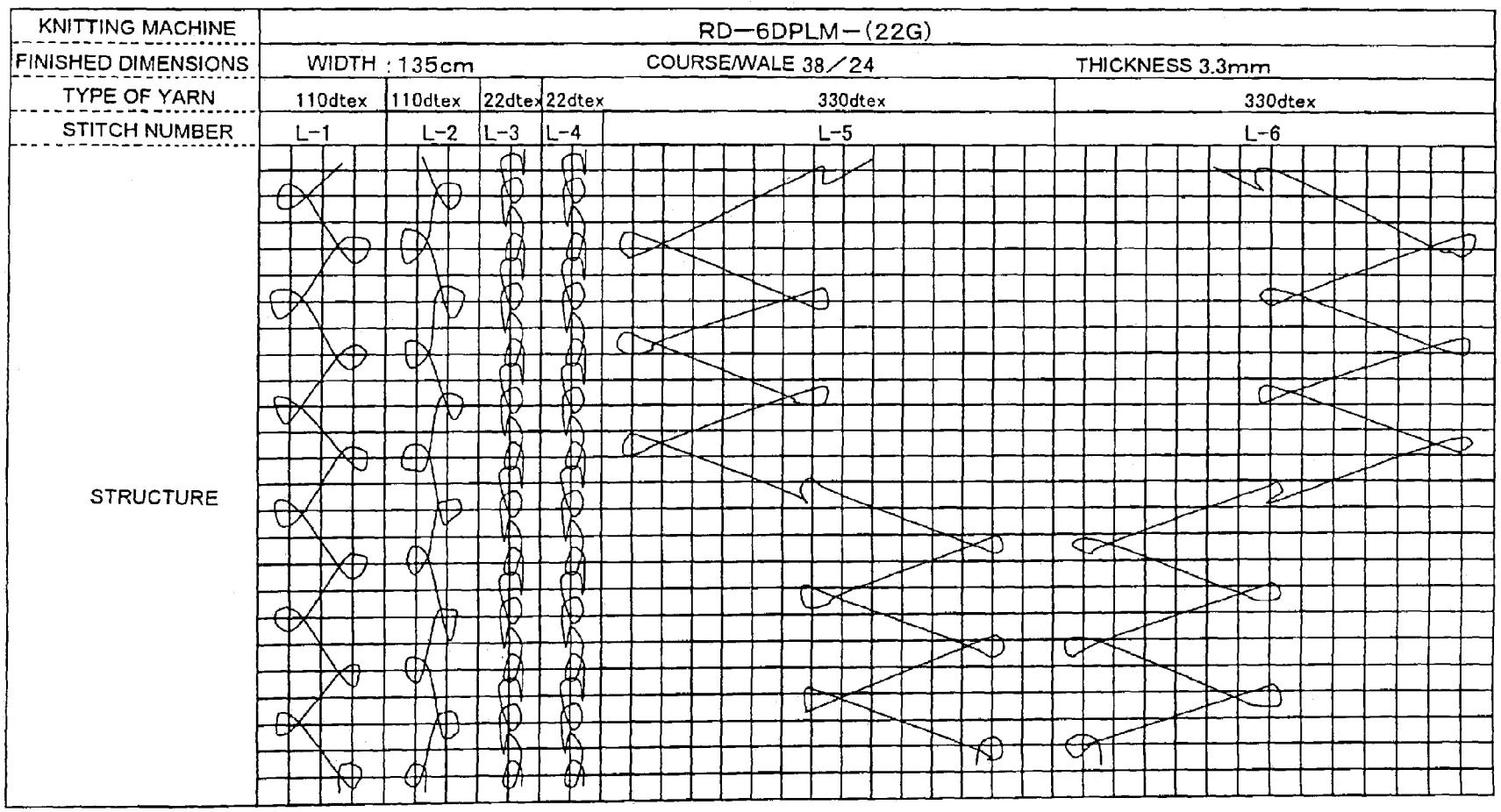
FIG. 14 is a diagram illustrating a structure according to Example 4.

A three-dimensional knitted fabric was produced on the basis of a design as shown in FIG. 14 by employing 100% polyester yarns as ground yarns and interconnection yarns. The fineness of ground yarns of an uneven ground structure of the fabric was 330 decitex.

The uneven ground structure was knitted by guiding the ground yarns through the guide bars L5 and L6 by a traverse width of six stitches. The resulting three-dimensional fabric structure was preset at 190° C. for one minute, dyed at 130° C., dried, and finally set at 150° C. for one minute. Thus, a three-dimensional knitted fabric was obtained which had a thickness of 3.1 mm and a knitting density of 38 courses/inch and 24 wales/inch and included projections each having a curved shape having a distinct curvature in section.

The three-dimensional knitted fabric thus obtained was evaluated by the aforesaid evaluation method. The results are shown in Table 1.

Comparative Example 1

Figure 15:
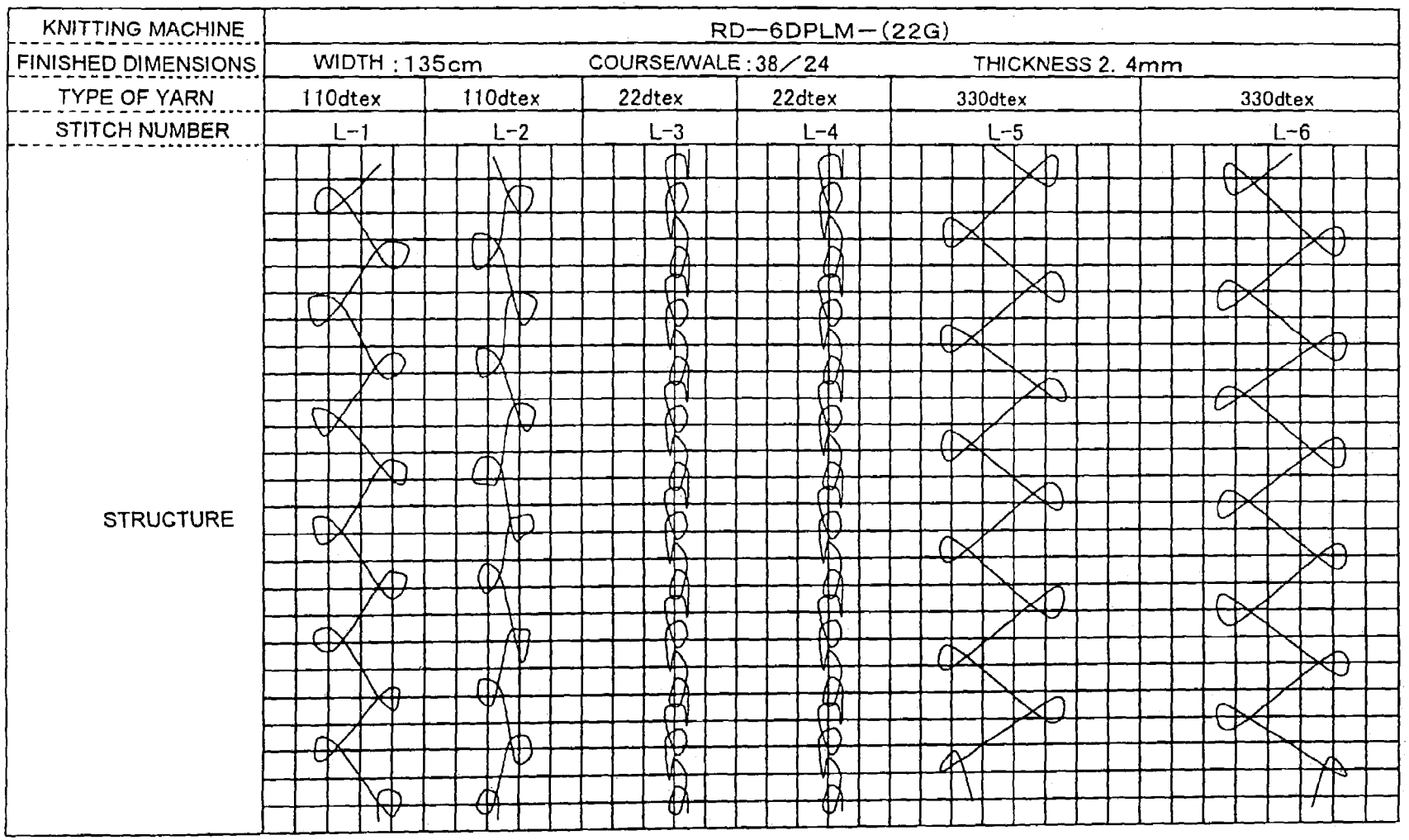
FIG. 15 is a diagram illustrating a structure according to Comparative Example 1.

A three-dimensional knitted fabric was produced on the basis of a design as shown in FIG. 15 by employing 100% polyester yarns as ground yarns and interconnection yarns. The fineness of ground yarns of a front plane ground structure of the fabric was 330 decitex.

The front plane ground structure was knitted by guiding the ground yarns through the guide bars L5 and L6 by a traverse width of three stitches without cast-off. The resulting three-dimensional fabric structure was preset at 190° C. for one minute, dyed at 130° C., dried, and finally set at 150° C. for one minute. Thus, a three-dimensional knitted fabric was obtained which had a thickness of 1.9 mm and a knitting density of 38 courses/inch and 24 wales/inch.

The three-dimensional knitted fabric thus obtained was evaluated by the aforesaid evaluation method. The results are shown in Table 1.

Comparative Example 2

Figure 16:
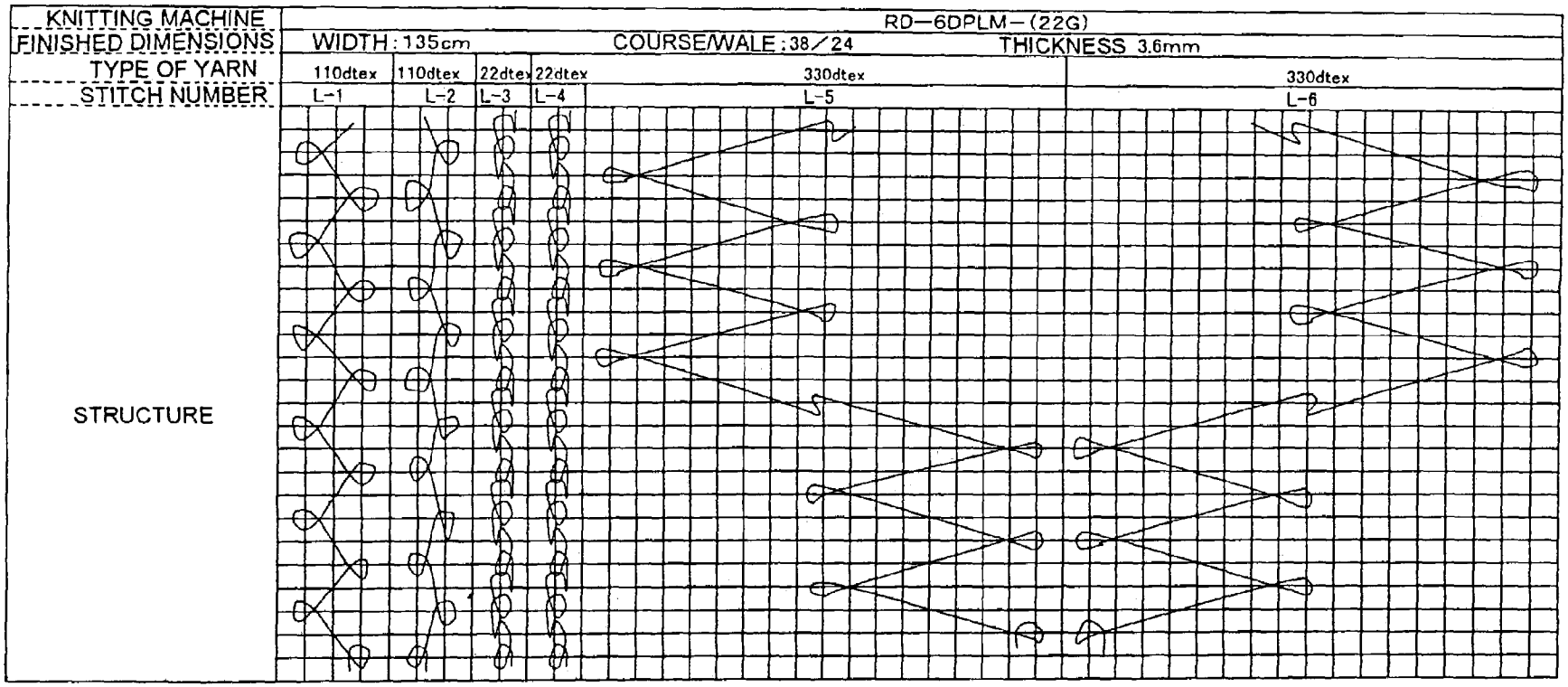
FIG. 16 is a diagram illustrating a structure according to Comparative Example 2.

A three-dimensional knitted fabric was produced on the basis of a design as shown in FIG. 16 by employing 100% polyester yarns as ground yarns and interconnection yarns. The fineness of ground yarns of an uneven ground structure of the fabric was 330 decitex.

The uneven ground structure was knitted by guiding the ground yarns through the guide bars L5 and L6 by a traverse width of eight stitches. The resulting three-dimensional fabric structure was preset at 190° C. for one minute, dyed at 130° C., dried, and finally set at 150° C. for one minute. Thus, a three-dimensional knitted fabric was obtained which had a thickness of 3.3 mm and a knitting density of 38 courses/inch and 24 wales/inch.

The three-dimensional knitted fabric thus obtained was evaluated by the aforesaid evaluation method. The results are shown in Table 1.

Comparative Example 3

Figure 17:
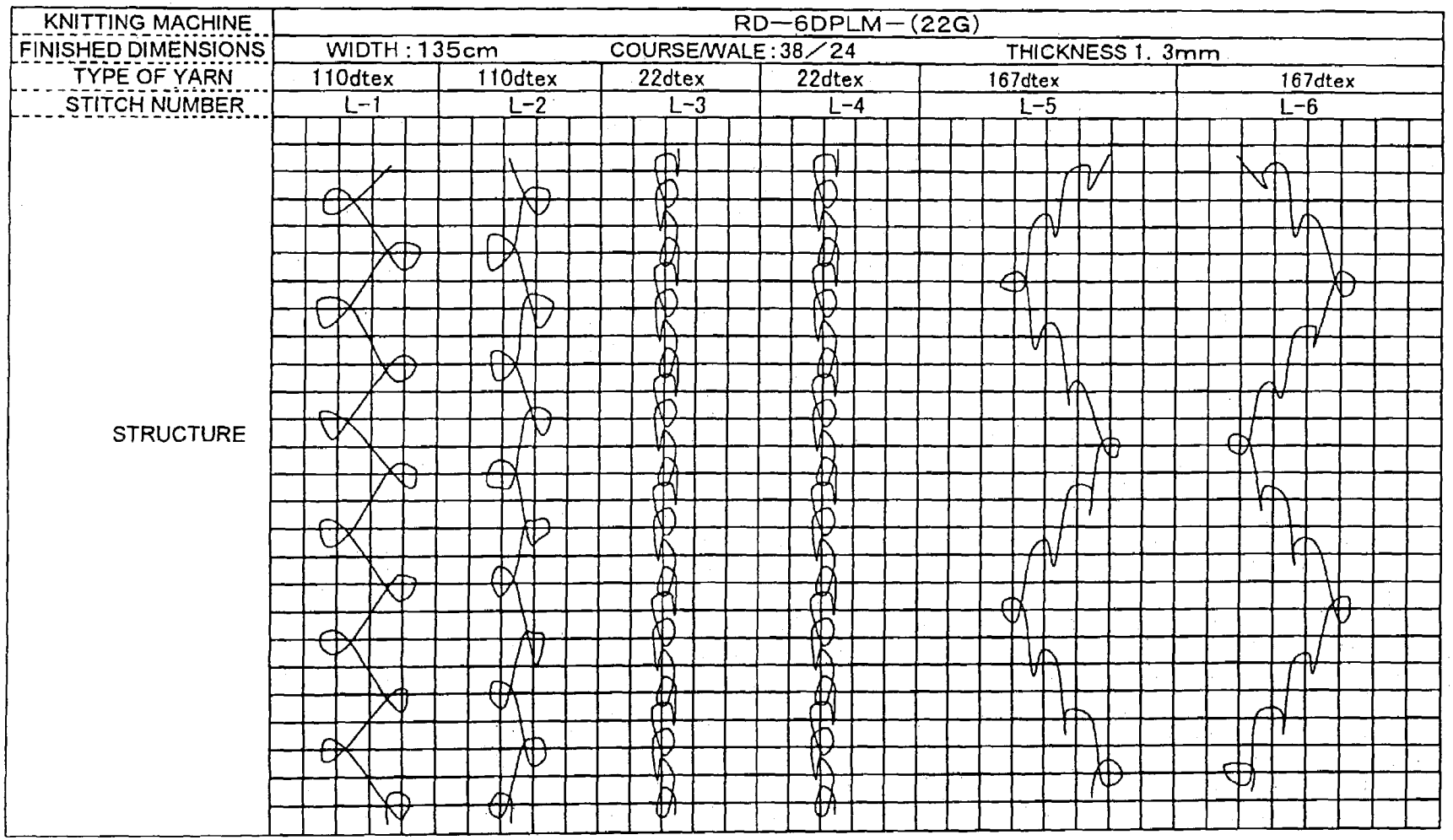
FIG. 17 is a diagram illustrating a structure according to Comparative Example 3.

A three-dimensional knitted fabric was produced on the basis of a design as shown in FIG. 17 by employing 100% polyester yarns as ground yarns and interconnection yarns. The fineness of ground yarns of a mesh ground structure of the fabric was 167 decitex.

The mesh ground structure was knitted by guiding the ground yarns through the guide bars L5 and L6 by a traverse width of one stitch. The resulting three-dimensional fabric structure was preset at 190° C. for one minute, dyed at 130° C., dried, and finally set at 150° C. for one minute. Thus, a three-dimensional knitted fabric was obtained which had a thickness of 1.3 mm and a knitting density of 38 courses/inch and 24 wales/inch.

The three-dimensional knitted fabric thus obtained was evaluated by the aforesaid evaluation method. The results are shown in Table 1.

Comparative Example 4

Figure 18:
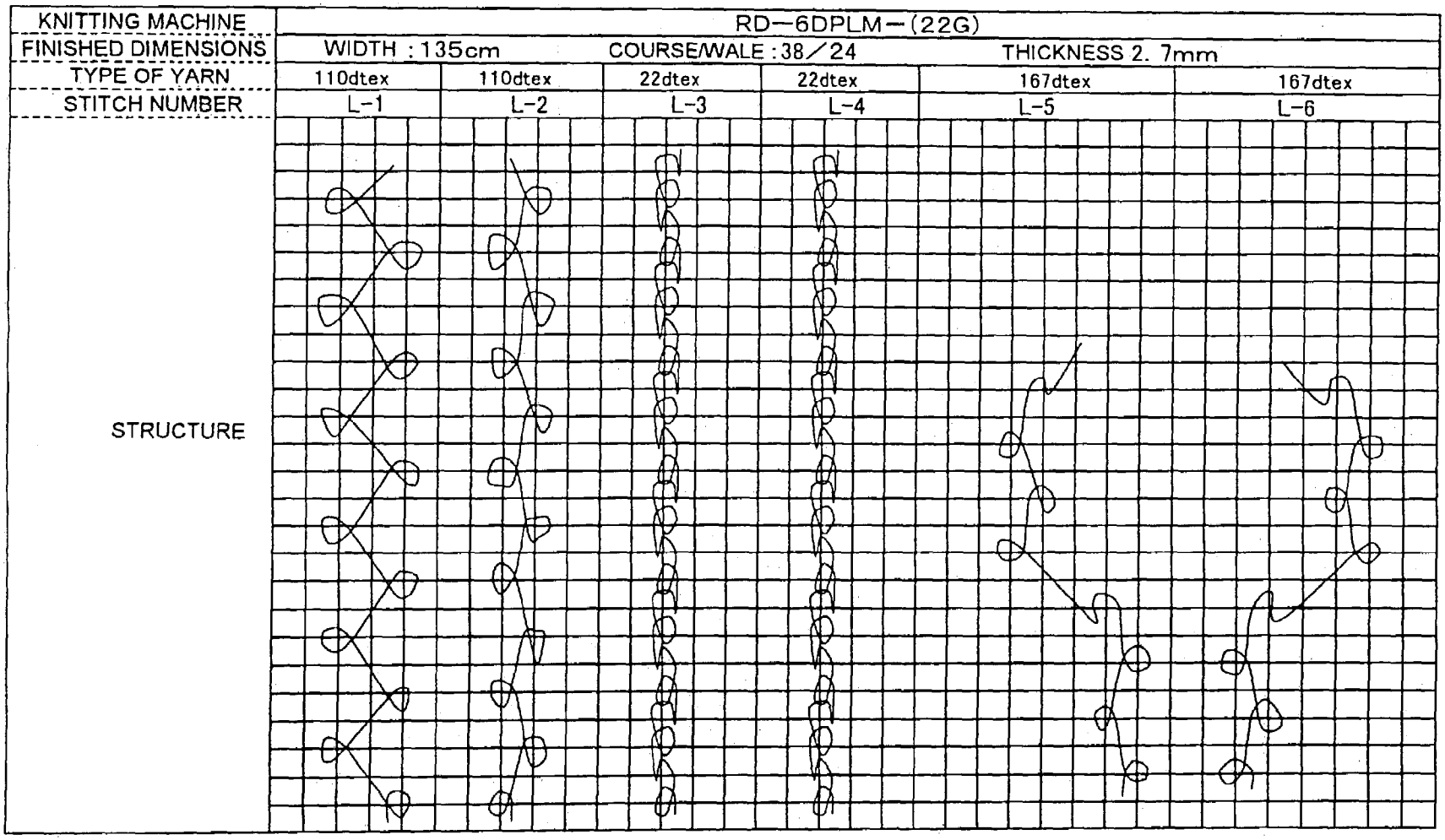
FIG. 18 is a diagram illustrating a structure according to Comparative Example 4.

A three-dimensional knitted fabric was produced on the basis of a design as shown in FIG. 18 by employing 100% polyester yarns as ground yarns and interconnection yarns. The fineness of ground yarns of a mesh ground structure of the fabric was 167 decitex.

The mesh ground structure was knitted by guiding the ground yarns through the guide bars L5 and L6 by a traverse width of one stitch. The resulting three-dimensional fabric structure was preset at 190° C. for one minute, dyed at 130° C., dried, and finally set at 150° C. for one minute. Thus, a three-dimensional knitted fabric was obtained which had a thickness of 2.7 mm and a knitting density of 38 courses/inch and 24 wales/inch.

The three-dimensional knitted fabric thus obtained was evaluated by the aforesaid evaluation method. The results are shown in Table 1.

TABLE 1

| | Example | | | |
|---|---|---|---|---|
| | 1 | 2 | 3 | 4 |
| Fineness (dtex) | 167 | 330 | 330 | 330 |
| Traverse width (stitches) | 3 | 3 | 4 | 6 |
| Openings | YES | YES | YES | YES |
| Contact area ratio | Δ | ○ | ○ | ○ |
| Thickness retention ratio | Δ | ○ | Δ | Δ |
| Sweatiness | ○ | ○ | ○ | ○ |
| Air permeability | ○ | ○ | ○ | ○ |

| | Comparative Example | | | |
|---|---|---|---|---|
| | 1 | 2 | 3 | 4 |
| Fineness (dtex) | 330 | 330 | 167 | 167 |
| Traverse width (stitches) | 3 | 8 | 1 | 1 |
| Openings | NO | YES | YES | YES |
| Contact area ratio | X | Δ | Δ | ○ |
| Thickness retention ratio | Δ | ○ | Δ | X |
| Sweatiness | X | Δ | X | X |
| Air permeability | X | Δ | ○ | ○ |

While the present invention has been described in detail by way of the embodiment thereof, it should be understood that the foregoing disclosure is merely illustrative of the technical principles of the present invention but not limitative of the same. The spirit and scope of the present invention are to be limited only by the appended claims.

This application corresponds to Japanese Patent Application No. 2001-303508 filed with the Japanese Patent Office on Sep. 28, 2001, the disclosure thereof being incorporated herein by reference.

What is claimed is:

1. A three-dimensional uneven knitted fabric comprising a double Raschel warp knit fabric having front and back ground knitted structures and an interconnection yarn knitted with the structures that unites the front and back ground structures together and forms a part between them having voids therein, at least one of the front and back ground structures having an uneven surface pattern in section of projections and depressions, wherein ground yarns of the at least one ground structure are traversed by a predetermined traverse width ranging from 3 to 7 stitches along the width direction of knitting so that the projections each have a curved shape having a distinct curvature in section, and the ground yarns of the at least one ground structure are cast off at a predetermined interval corresponding to the predetermined traverse width of the ground yarns so that the depressions each have an opening, wherein (i) tensile forces toward centers of the projections are provided in portions of the at least one ground structure where the plurality of ground yarns overlap with each other, and (ii) the around yarns are cast off at the predetermined interval so that counter forces canceling the tensile forces do not occur.

2. The three-dimensional uneven knitted fabric as set forth in claim 1, wherein the ground yarns each have a fineness of from 150 to 550 decitex.

3. The three-dimensional uneven knitted fabric as set forth in claim 1, wherein the ground yarns are polyester yarns.

4. The three-dimensional uneven knitted fabric as set forth in claim 1, which is applied to an automobile seat.

5. The three-dimensional uneven knitted fabric as set forth in claim 1, wherein the distinct curvature in section of the projections is a continuous curved surface and the openings of the depressions are in the surface of the at least one ground structure.

* * * * *

UNITED STATES PATENT AND TRADEMARK OFFICE

CERTIFICATE OF CORRECTION

PATENT NO. : 7,235,504 B2
APPLICATION NO. : 10/255677
DATED : June 26, 2007
INVENTOR(S) : Fumio Shirasaki et al.

It is certified that error appears in the above-identified patent and that said Letters Patent is hereby corrected as shown below:

In claim 1, column 12, line 4, “around” should read -- ground--.

Signed and Sealed this

Fourth Day of December, 2007

JON W. DUDAS
*Director of the United States Patent and Trademark Office*